US006607429B1

(12) United States Patent
Damgaard

(10) Patent No.: US 6,607,429 B1
(45) Date of Patent: Aug. 19, 2003

(54) SUPPORT FOR TEMPORARY FIXATION OF SELF-STICKING ABRASIVE AND/OR POLISHING SHEET

(75) Inventor: Morten J. Damgaard, Store Merløse (DK)

(73) Assignee: Struers A/S, Rodovre (DK)

( * ) Notice: Subject to any disclaimer, the term of this patent is extended or adjusted under 35 U.S.C. 154(b) by 0 days.

(21) Appl. No.: 09/786,632

(22) PCT Filed: Sep. 8, 1999

(86) PCT No.: PCT/DK99/00472

§ 371 (c)(1),
(2), (4) Date: Apr. 3, 2001

(87) PCT Pub. No.: WO00/13854

PCT Pub. Date: Mar. 16, 2000

(51) Int. Cl.[7] ..... B24D 11/00
(52) U.S. Cl. ..... 451/442; 451/539
(58) Field of Search ..... 451/442, 458, 451/539, 538, 526, 533, 921

(56) References Cited

U.S. PATENT DOCUMENTS 3,875,703 A * 4/1975 Clemente ..... 451/538
4,788,798 A * 12/1988 DeFranco et al. ..... 451/538
6,036,586 A * 3/2000 Ward ..... 451/287
6,089,963 A * 7/2000 Winad et al. ..... 451/921
6,190,746 B1 * 2/2001 Ishii et al. ..... 451/539

FOREIGN PATENT DOCUMENTS

| | | |
|---|---|---|
| EP | 0005161 | 11/1979 |
| EP | 0414346 | 2/1991 |
| EP | 0418093 | 3/1991 |
| EP | 0513772 | 11/1992 |
| FR | 2724864 | 3/1996 |
| FR | 2758285 | 7/1998 |
| WO | 9708969 | 3/1997 |

* cited by examiner

*Primary Examiner*—Robert A. Rose
(74) *Attorney, Agent, or Firm*—Dykema Gossett PLLC

(57) ABSTRACT

The present invention relates to a support (4–7) for temporary fixation of a self-sticking abrasive and/or polishing sheet (2) comprising an adhesive layer (3), said support (4–7) comprising a surface for receiving the sheet (2), where the surface of the support (4–7) is so adapted that the resulting adhesive force between the sheet (2) and the support (4–7) is varied over the surface of the support (4–7).

20 Claims, 2 Drawing Sheets

SUPPORT FOR TEMPORARY FIXATION OF SELF-STICKING ABRASIVE AND/OR POLISHING SHEET

BACKGROUND OF THE INVENTION

1. Field of the Invention

The present invention relates to a support for temporary fixation of a self-sticking abrasive and/or polishing sheet which includes an adhesive layer. The support includes a support surface onto which the self-sticking sheet can be applied.

2. The Prior Art

In the art of materialography (the study of materials, e.g. metals; metallography) it is common practice to grind and/or polish the samples before performing the various analysis on them. For most analyses, it is crucial that the surface of the sample to be analyzed is as smooth as possible.

Accordingly, a great number of abrasive and polishing means, e.g., in terms of abrasive sheets having various grinding grain sizes, are used. The treatment of a materialographic sample normally starts with an abrasive sheet having a relatively large grain size and eventually ends up with an abrasive sheet having a very small grain size and/or a polishing cloth, the process including a number of treatment steps using means each having different and gradually reduced grain sizes. It is therefore crucial that the changing of the abrasive and/or polishing sheet is as simple and easy as possible. Furthermore, it is desirable that the reuse of an abrasive and/or polishing sheet which is not worn out is facilitated.

It is known in the art of polishing and/or grinding to use abrasive or polishing sheets having a frontal face for treating the sample and comprising a layer of adhesive on the backside in order to fixate the sheet temporarily to a rotatable and/or otherwise movable abutment of a grinding and polishing apparatus during the abrasion or polishing process.

These self-sticking abrasives and/or polishing sheets are also widely used for preparing materialographic samples, where they are adhered directly to the normally rotatable abutment of a grinding and polishing apparatus.

However, it is generally the case that the adhesive force between the commonly used sheets and the ordinary abutment of a typical grinding and polishing apparatus is rather strong, and consequently the removal of the sheet becomes very troublesome. Furthermore, it is thus very common that the sheet will become wrinkled or torn during removal and accordingly completely unsuited for reuse which is an otherwise desirable option in case the sheet is not completely worn out.

EP 2 750 354 discloses a rotatable abutment in a grinding and/or polishing machine. At the side facing the abrasive or polishing sheet the abutment comprises a coating of a material which is softer than the material used for the platter itself. As an example of a material suitable as coating polytetrafluoruethylene (Teflon®) is mentioned. The coating should facilitate the removal of used or wrongly mounted abrasive or polishing sheets from the abutment.

Thus EP 2 750 354 teaches a way of lowering the adhesive force by introducing a surface of a releasing material. However, if the adhesive force is reduced too much, the sheet will be displaced during use which could result in severe damage to the sample, the machinery and/or even injury on the operating personal.

Accordingly, there persists a need for a solution to the problem of fulfilling the apparently mutually exclusive objectives of securing the commonly used self-sticking abrasive or polishing sheets to the movable abutment, while at the same time making it easy to remove the sheets after use and in a manner which does not damage the sheets which are not completely worn out.

SUMMARY OF THE INVENTION

This object is achieved by the support according to the invention which has the property that the surface of the support is so adapted that when a self-sticking abrasive or polishing sheets is applied to the support surface, the resulting adhesive force between the sheet and the support surface is varied over the surface of the support.

The invention also relates to a support in combination with a self-sticking abrasive or polishing sheets.

The term support as used herein designates an integral part of an abutment or an adapter adapted to be placed on an abutment, optionally temporarily placed on an abutment.

The support comprises a generally planar support surface area onto which a self-sticking abrasive or polishing sheets can be adhered. The term "generally planar support surface" means that the surface may contain small irregularities such as small protrusions or cavities, provided that the irregularities do not prevent a self-sticking abrasive or polishing sheets to be adhered to the surface, and to remain adheared during use of the abutment containing said support, in a polishing or abrasion process.

The support surface is defined by an outer periphery, this periphery normally is a border line to an outer area of the support, said outer area forms an angle with said support surface.

The self-sticking abrasive or polishing sheets, also designated "grinding sheet" may be of any conventional type comprising a first side (front face)having an abrasive or polishing layer, and a second side (back side) totally or partly covered with an adhesive.

The invention is based on the surprising recognition that only a part of the abrasive sheet needs be strongly adhered to the movable support in order to ensure a secure fixation. When the contact area exhibiting strong adhesion is reduced, the ease of dismounting of the sheet is significantly increased. However, even though only a part of said contact area remains, a surprisingly large amount of the sheet's ability to stay fixed during use is intact.

It is believed that this advantageous effect is at least partly due to the fact that the forces, which prevent the sheet from being displaced during use, work in a direction parallel with the surface plane of the sheet whereas the forces keeping the sheet to the abutment during dismounting are substantially perpendicular to said plane. It has surprisingly been found that the two forces depend differently on the size of the contact area exhibiting strong adhesion, i.e. the force necessary for dismounting the sheet is reduced relatively more than the force needed for displacing the sheet during use, when the contact area exhibiting strong adhesion is reduced.

According to the invention, it is thus possible to meet the objective of facilitating the dismounting and reuse of abrasive and/or polishing sheets from a movable abutment while at the same time substantially maintaining all other properties, i.e. the safety during use and the quality of the abrasion and/or polishing process. According to the basic invention, this is accomplished by manipulating the adhesive force between the sheet and the abutment in a manner so that the force varies from the edges to the centre of the sheet. Furthermore, it is an advantage that any conventional abrasive and/or polishing sheets may be used together with the support according to the invention.

Although the support surface of the support, according to the invention, in principle can have any shape, e.g. square, triangular or circular, most grinding and/or polishing apparatus for use in the art of materialography have rotatable circular abutments, and thus it is highly preferable that the support surface of the support according to the invention is circular. Accordingly, the adhesive force is preferably varied in radial direction of the circular support surface. By the term "radial direction" means the direction from the centre to the periphery of the support surface.

The support surface of the support, according to the invention at least two subareas having different surface tension, whereby the adhesive force between said subareas and a abrasive and/or polishing sheet applied onto said support surface, differs from each other.

A subarea of the support surface means a segment or a zone of the support surface, which segment or zone may have any size and shape. The support surface may e.g. comprise a number of discrete zones, which zones each has a surface tension different from each other. In another embodiment the support surface may have a number of discrete zones placed apart from each other and a basis zone surrounding all of the discrete zones, wherein said discrete zone has a surface tension different form the surface tension of the basis zone. Yet in another embodiment the surface tension may vary through out the support surface.

According to the invention, it is preferred that the zone(s) of the support surface allowing for stronger adhesive force (i.e. having a relatively high surface tension) as well as the zone(s) allowing for lower adhesive force (i.e. having a relatively low surface tension) are in essence evenly distributed as seen from the centre of the support, e.g. in terms of a preferably symmetrical pattern extending from the centre towards the edge(s) in all radial directions.

According to a preferred embodiment of the invention, the surface tension is lowered in a zone along the edges relatively to the central zone so as to make it easy to get a firm grip on the edge of the abrasive and/or polishing means when dismounting the means.

However, many polishing means, e.g. in terms of textile based means, shrink due to the optional use of a lubricant during the polishing process. Such a shrinking means will elevate itself from the support possibly leading to severe damage to the treated sample and the means itself.

It has surprisingly been found that by having a zone exhibiting strong adhesive force along the edge(s) (i.e. having a relatively high surface tension) and/or at least in the proximity of the edge(s) the above mentioned adverse elevation caused by shrinking can substantially be eliminated.

Accordingly, a particularly preferred embodiment of the invention has a relatively high surface tension in one or more zones along the edge(s) and/or in the proximity of the edge(s) of the sheet relative to the surface tension of the subareas or zones towards the centre.

It has proven to be particularly expedient if the zone having a relatively high surface tension along the edge(s) is around 5 to 25 mm wide preferably around 10 to 20 mm wide almost regardless the overall size of the support.

The invention furthermore rests on the recognition that the adhesive force between a typical self sticking sheet and a corresponding abutment depends on both the adhesive material itself, the size of area of contact between the sheet and the abutment and the surface tension of the material of which the surface of the abutment is made up.

According to a particularly preferred embodiment of the invention, the surface tension of the surface of the support is manipulated in order to obtain the varied adhesive force according to the invention.

This can, according to the invention, be done by employing different materials and/or by treating the surface material in different ways in separate zones or subareas in order to make the various zones exhibiting appropriate surface tension and accordingly provide a support onto which a abrasive and/or polishing sheets may be safely secured and at the same time be relatively easy to removed and replaced with another.

For the zone(s) exhibiting strong adhesive force, it is preferable to use one or more materials having a surface tension which in relatively high compared to the surface tension of the zone(s) exhibiting low adhesive force, such as above around 36 dyn/cm, more preferable between 38 dyn/cm and 60 dyn/cm and even more preferable between 42 dyn/cm and 50 dyn/cm.

Examples of applicable and preferable materials for use in the zone(s) exhibiting strong adhesive force include epoxy, cellulose based polymers, polyamide (Nylon™), polyester, polycarbonate, resorcinol, phenol based polymers, urea formaldehyde, and/or mixtures or co-polymers thereof. It is particularly preferred to use epoxy based lacquer.

For the zone(s) exhibiting reduced adhesive force compared to the above mentioned zone(s) exhibiting stronger adhesive force it is preferable to use one or more materials having a surface tension which in relatively low compared to the surface tension of the zone(s) exhibiting high adhesive force in the same embodiment, e.g. below around 40 dyn/cm but above around 20 dyn/cm, more preferable between 40 dyn/cm and 32 dyn/cm and even more preferable between 38 dyn/cm and 34 dyn/cm.

Examples of applicable and preferable materials for use in the zone(s) exhibiting reduced adhesive force include lacquers based on polyurethane, polyethylene, polypropylene, rubbers, polystyrene, polyvinyl acetate, silicon based polymers, polytetrafluoroethylene (Teflon™), and/or mixtures or co-polymers thereof. It is particularly preferred to use lacquers based on polyurethane.

As mentioned above, it is possible to obtain the prescribed zones by applying one material in zones on top of another, i.e. a base layer, e.g. by covering discrete subareas of the base layer with a lacquer. By doing so, a number of protrusions relative to the surface of the base layer is, however, formed.

It has surprisingly been found that if such protrusions and/or similar corresponding cavities are formed and furthermore are organized so as to allow air escape during mounting of the sheet and/or air entry during dismounting, these operations are even further facilitated.

Accordingly, it is a particularly preferred embodiment according to the invention to apply a number of protrusions and/or cavities in a way that allows the air to escape during mounting and/or allows the air to enter during dismounting.

This type of air-effect can be obtained in various manners, for instance if the protrusions are discrete subareas between which a number of channels leading to the edges of the abutment are formed, and/or if the optionally employed cavities themselves form such channels.

This has the further advantage that it prevents air bubbles from being formed between the sheet and the abutment during mounting, which bubble formation in most cases is highly undesirable because it will make the surface of the sheet uneven and consequently the sample will be treated unevenly.

Naturally, if the protrusions are too high, or the cavities are too deep this will also result in an uneven treatment of the sample. On the other hand, if the difference in level is too small, no significant effect is obtained. According to the invention, it has been found that the difference in level between the average highest spot and the average lowest spot is preferably between around 3 $\mu$m and 200 $\mu$m, and more preferably between 5 $\mu$m and 150 $\mu$m and even more preferably between 10 $\mu$m and 50 $\mu$m.

Furthermore, if the protrusions and/or cavities are spaced too widely apart, no significant effect is obtained. This is of course also true if the protrusions and/or cavities are spaced too narrowly.

If the protrusions e.g. are formed by a material having a lower surface tension than the base layer, it has, according to the invention, proven particularly advantageous to space the protrusions at a centre distance of around 1–3 mm, preferably around 2 mm in the zones exhibiting strong adhesive force and at a distance of around 1–3 mm, preferably around 2 mm in zones exhibiting weakened adhesive force.

According to the invention, it is generally preferable to employ from around 10 to 160 protrusions and/or cavities pr. $cm^2$ in the zones exhibiting strong adhesive force, more preferably from around 40 to 60 pr. $cm^2$ and to employ from around 10 to 100 protrusions and/or cavities pr. $cm^2$ in the zones exhibiting weaker adhesive force, more preferably from around 40 to 60 pr. $cm^2$.

According to the invention, it is generally preferable that the protrusions and/or cavities cover from around 10 to 90% of the support surface, more preferably from around 40 to 60% of the support surface.

In case the surface tension properties of the protrusions/cavities and the base layer are reversed, the dimensions regarding the area sizes are reversed accordingly in order to provide the prescribed adhesive forces in the various zones.

The prescribed differences in surface height level can be obtained by any means capable of inducing such, e.g. by applying a material to the surface in order to make protrusions, by removing material in order to make the cavities and/or by displacing material to obtain protrusions and/or cavities.

The protrusions on the support are as mentioned preferably made by means of an epoxy lacquer or the like disposed directly on the surface of the support. The lacquer can be placed on the surface of the support using any means including the particularly preferred methods of silk screening and/or serigraphy. These methods have proven particularly expedient and enable the exact positioning, sizing and shaping of the protrusions.

Cavities are preferably made by means of etching, corrosion, stamping, pressing, moulding, burning or the like.

It has furthermore been found that the shape of the protrusions and/or cavities might effect the above mentioned air-effect. In case of protrusions, these are preferably substantially round, square, hexagonal and/or part of a fractal pattern or a combination of these shapes. It has been found that these shapes provide superior air-effect and/or are particularly expedient to make. According to the invention, it is most preferable to employ square and/or particularly hexagonally shaped protrusions, as these facilitate the creation of a uniform pattern of such protrusion leaving also uniform air channels between the protrusions. It is believed that this facilitates the air-effect the most.

According to another preferred embodiment according to the invention, the protrusions and/or cavities form part of a raster image. It has surprisingly been found that it is possible to use the protrusions and/or cavities for forming raster images on the support without impeding the above disclosed advantages, thus further solving the problem of marking the product with specifications and/or logos without affecting the product.

It is also believed that applying any small level differences and particularly protrusions and/or cavities as disclosed above at the surface of the support according to the invention dealing with manipulation of surface tension, might at least partly increase the frictional force between the support and an applied self-sticking abrasive and/or polishing sheet in any direction parallel with the support surface plane and thus possibly contribute to fixation of the sheet during use, even when the adhesive force is reduced significantly by means of a reduced surface tension.

The invention also relates to a support as defined above in combination with a self-sticking abrasive and/or polishing sheet comprising an adhesive layer, wherein said support comprising a generally planar support surface having a area defined by an outer periphery wherein said surface comprising subareas having different surface tension so that the adhesive force between the respective support surface subareas and the abrasive and/or polishing sheet is different from each other in said respective subareas.

The support according to the invention can be an integrated part of the movable abutment in a grinding and/or polishing apparatus, in terms of constituting the part of the apparatus containing the surface layer facing the self-sticking backside of the abrasive and/or polishing sheet of said abutment. Accordingly, the invention furthermore relates to a polishing and/or grinding apparatus comprising a movable abutment for the abrasive and/or polishing sheet, said abutment having a support surface facing the backside of the sheet according to the invention.

However, grinding and/or polishing apparatus are generally very expensive and have long life cycles. Therefore, there is a need for finding a way to modify existing grinding and/or polishing apparatus in order to eliminate the disadvantages disclosed in the introduction.

Accordingly, the invention also relates to an adapter for mounting in an existing apparatus, thus eliminating the shortcomings of the prior art equipment and in order to obtain the above disclosed advantages according to the invention.

There are generally two types of grinding and/or polishing apparatus for treating materialographic samples. One type of apparatus works primarily with the previously mentioned self-sticking sheets and the other one is adapted to also/alternatively employ magnetism in order to fixate special abrasive and/or polishing sheets comprising ferromagnetic material.

Both types of apparatus exhibit the disadvantages disclosed in the introduction when used with the ordinary self-sticking abrasive and/polishing sheets. According to the invention, it is now possible to make an adapter which can be mounted on the existing movable abutment of any prior art apparatus.

To modify the prior art apparatus not employing magnetism, it is preferred that the support according to the invention is constituted by an adapter in the form of a thin base layer having a first support surface for facing the self-sticking abrasive and/or polishing sheet which first surface exhibits a modified adhesive force towards the self-sticking abrasive or polishing sheet according to the invention and as disclosed above, and having a second surface facing the surface of the prior art abutment.

The second surface is preferably provided with means for fixating the adapter to the abutment. Such fixating means can be an adhesive layer of any adhesive material being capable of fixating the adapter to the abutment during use. The adapter can be provided with an adhesive material which enables and/or facilitates the removal of the adapter which can be desirable for various reasons such as employment of another type of abrasive and/or polishing sheets or the complete replacement of the abutment. Such adhesives include removable acrylic based adhesive.

The adhesive force between the adapter and the abutment for a temporary fixation is preferably less than around 10 to 15 N per 25 mm, but more than around 2 N/25 mm and more preferably between around 5 to 10 N/25 mm.

According to another embodiment of the adapter according to the invention, it is preferable that the adapter is permanently adhered to the abutment. This can preferably be done by means of a silicon based reactive adhesive.

The adhesive force between the adapter and the abutment for a relatively permanent fixation is preferably at least around 10 to 15 N per 25 mm and more preferably around 20 to 50 N/25 mm.

The adhesive layer on the second side of the adapter is regardless the type preferably provided with a release liner, which can be removed by the user prior to the mounting of the adapter on the abutment of a prior art grinding and/or polishing apparatus.

Any type of material having good physical/mechanical properties such as strength can be used as base layer for the adapter according to the invention. Applicable and preferable material include various metals such as steel and aluminium, and various plastics such as polyethylene, polypropylene, polyester and any combinations of these materials. Particularly preferred is steel, aluminium and polyester.

This type of adapter can also be used to modify apparatus comprising a magnetized movable abutment. However, according to the invention, it is preferred to modify the prior art apparatus employing magnetism, by means of a sheet formed adapter comprising sufficiently ferromagnetic material to keep it safely fixated to the magnetized abutment during use. The use of magnetism makes it possible to easily dismount or change the adapter if need be, and the adapter can even be temporarily dismounted during placement or replacement of the abrasive and/or polishing sheet.

It is an easy task to dismount the ferromagnetic adapter by grasping an edge of the ferromagnetic adapter according to the invention and pulling this edge away from the magnetic support. On the other hand, the adapter is under the influence of strong magnetic forces in the horizontal direction when it is in a plane position on the surface of the magnetic abutment and thereby ensures that the abrasive or polishing means mounted on the adapter does not slip in relation to the abutment during abrasion or polishing. A contributory factor is that the items to be abraded or polished will normally be urged against the abrasive or polishing sheet during the abrasion or polishing.

Furthermore, by employing a number of such ferromagnetic adapters according to the invention comprising sufficiently ferromagnetic material, each type of abrasive and/or polishing sheet may be placed on a separate adapter and need only be dismounted therefrom when completely worn out, thus eliminating the problem regarding the potential damaging of not worn out sheets during dismounting entirely. Accordingly, if the grinding and/or polishing process requires several steps, each step can have its own adapter.

A further advantage of this embodiment of the adapter according to the invention is that when the reusable sheets do not need to be dismounted temporarily from the adapter between uses, the adhesive force between the two will stay intact. When a sheet is temporarily removed by the prior art methods, it is necessary to cover the adhesive layer of the sheet during storage, which firstly is troublesome because the original release liner often is damaged or lost and secondly because it might potentially have an adverse effect on the adhesive layer on the sheet, in terms of the adhesive becoming contaminated with dust, grease, lubricant and/or chips or flakes from the grinding or polishing process thus reducing the adhesion severely.

The ferromagnetic material according to this embodiment can be in any form and placed anywhere in the adapter, e.g. in terms of ferromagnetic granules in a polymer coating. However, according to the invention, it is strongly preferred to use a metal foil as base layer.

Besides possessing higher mechanical strength than a plastic basis layer containing particles of a ferromagnetic substance, a foil of a ferromagnetic substance, such as an iron foil, has smaller resilience and a better heat conductivity, so that the frictional heat which is generated during the abrasion or polishing can be discharged via the abutment.

It is preferred to use a ferromagnetic foil having a thickness of around 0.05–1 mm, as thinner foils do not have the desired strength, and foils having a larger thickness than 1 mm are so rigid that they impede removal from and mounting on the abutment. The thickness of the foil is preferably around 0.1 to 0.7 mm and more preferably around 0.25 to 0.35 mm, and it has turned out to be particularly expedient to use iron foils having a thickness of around 0.3 mm.

In order to avoid corrosion of the iron foil, it is preferred to coat the foil with a base lacquer and/or plate it with a thin layer of another metal or alloy, e.g. nickel, chromium and/or preferably tin.

An adapter comprising a slim iron foil as disclosed above will, depending on the magnitude of magnetism of the rotatable abutment, normally provide sufficient magnetic force in order to stay in place during use and particularly during polishing and lighter grinding.

However, when performing grinding where the frictional force between the abrasive sheet and the sample is high, the ordinary adapter might be displaced relative to the support, which is highly undesirable. Nevertheless, it is generally undesirable to increase the magnetic force between the abutment and the adapter because of thus increased cost of production and because the detachment of the adapter, for instance when the ferromagnetic abrasive and/or polishing sheets is to be used, will become too troublesome.

Accordingly, it has proven advantageous to increase the friction between the adapter and the magnetic abutment.

According to the invention this is obtainable by providing the side of the foil facing the abutment with a thin, friction-increasing coating, such as a coating of a plastics, in terms of a synthetic resin, in which fine, hard particles are embedded, such as particles of $Al_2O_3$ or SiC. The plastics coating is preferably so thin that the hard grains which preferably have a grain size from F220 to F320, project above the top side of the plastics coating and hereby can be brought into direct contact with the magnetic support.

By applying such a friction increasing layer according to the invention, it has proven possible to increase the friction coefficient to the double in horizontal direction between an attachment means according to the invention and the magnetized abutment. For example the force for parallel displacing an attachment means according to the invention and comprising a 0.280 mm thick sheet iron foil relative to the support is increased from about 0.15 N/cm$^2$ to about 0.25 to 0.35 N/cm$^2$, as measured with no pressure other than the magnetic force acting between the magnet and the sheet foil applied to the adapter.

The thin plastics layer can e.g. consist of or comprise epoxy, polyester, polyurethane or acrylic plastics.

The support surface for the self-sticking abrasive and/or polishing sheet according to the invention can generally have any shape. However, preferably the support surface has substantially the geometrical shape of the abrasive and/or polishing sheet and preferably the support surface has the same area size as the sheets or optionally a larger size.

Most abutments of grinding and/or polishing apparatus are round and accordingly, the support surface for the self-sticking abrasive and/or polishing sheet according to the invention is most preferred circular shaped having the same or smaller diameter as the abutment. It is, however, obvious that the invention can be used analogously on sheets and abutments having other shapes, e.g. square.

The adhesive material used for a typical self sticking sheet exhibits a standard adhesive force towards steel in the range of about 5 to about 20 N/25 mm.

Preferably, the adhesive force between a typical prior art sheet and the support according to the invention is at least around 5 N/25 mm in at least around 75% of the surface area.

The term protrusion designates any kind of elevation above the general surface level of the support surface.

The term cavity designates any depression below the general surface level of the support surface.

The surface tensions are in dyn/cm and are measured by DIN 53 364 and/or ASTM D 2578-84.

The invention will now be further illustrated by means of illustrations.

DETAILED DESCRIPTION OF PREFERRED EMBODIMENTS

Figure 1:
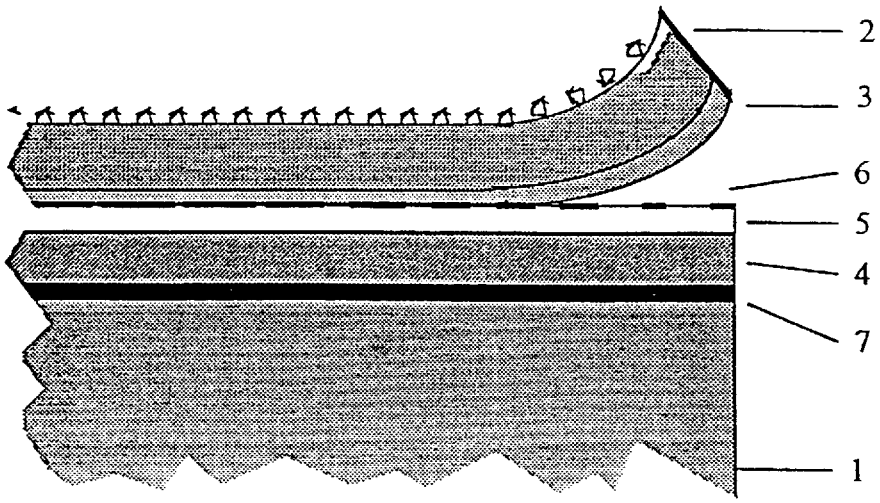
FIG. 1 shows a sectional view of an adapter according to the invention.

In FIG. 1 is shown in sectional view a schematic of a rotatable magnetized abutment 1 of a prior art polishing and grinding apparatus. On the abutment, a support in terms of an adapter (comprising 4–7) according to the invention is mounted and fixed by means of magnetism, said adapter comprising a base layer 4 of shim steel and a coating of a first lacquer 5 having a relatively high surface tension and discrete areas 6 covered with a second lacquer having a relatively low surface tension on the top side and a friction enhancing layer 7 on the bottom side facing the abutment 1. A prior art self sticking abrasive means 2 is adhered to the surface (5 and 6) of the support by means of an adhesive layer 3 disposed on the abrasive means. It is apparent from the sketch that the first lacquer 5 constitutes most of the surface area of the support towards the edge and the second lacquer 6 constitutes most of the surface area of the support towards the centre, thus providing a higher overall average surface tension at the edge and a lower overall average surface tension towards the centre. If the surface tension ratio of the lacquers 5 and 6 is reversed, the area sizes covered by said lacquers 5 and 6 should accordingly be inverted accordingly.

Figure 2:
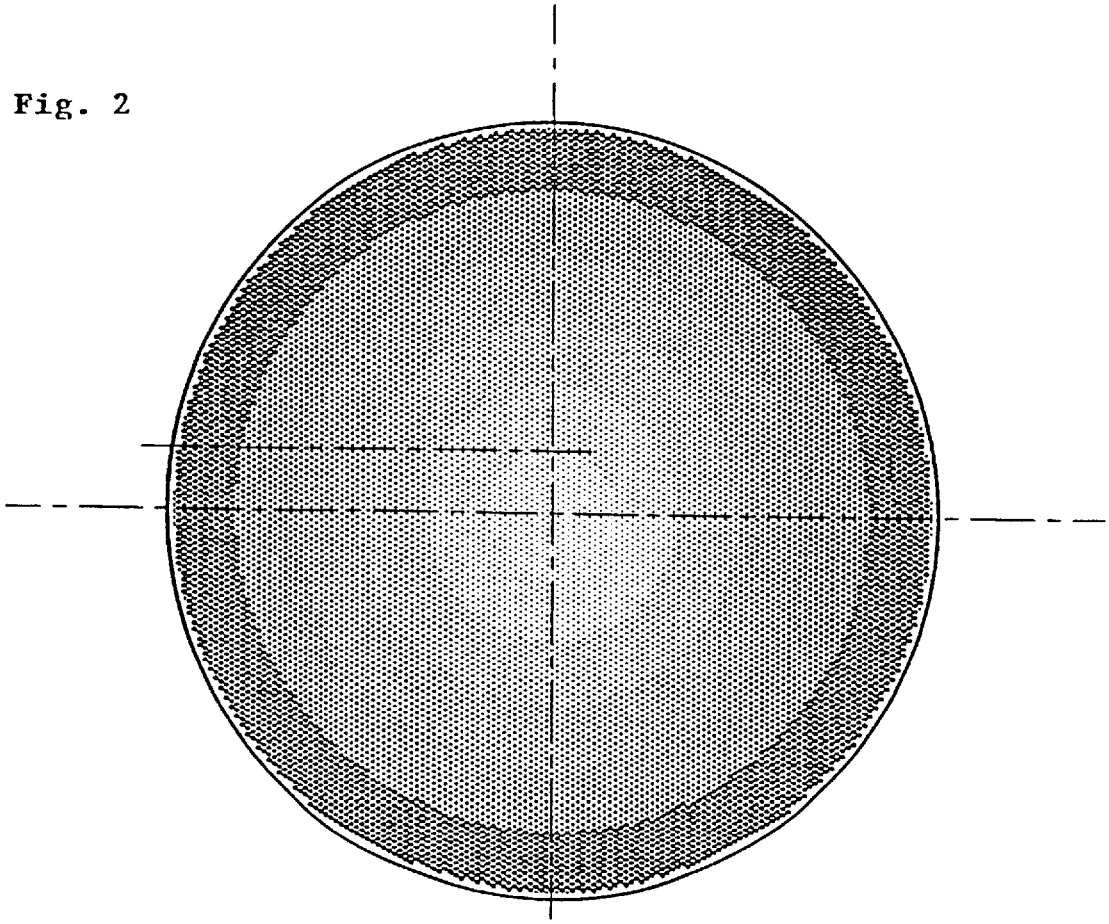
FIG. 2 shows the surface of a preferred embodiment of the support according to the invention.

In FIG. 2 is shown the surface of a preferred embodiment of the support according to the invention. The support surface is covered with small protrusions varying in size from the edge to the centre, with the largest protrusions at the edge and the smallest at the centre. Protrusions of mutually similar size are placed in annular zones. This embodiment corresponds to the embodiment of the invention disclosed in more detail in example 1 below.

Figure 3:
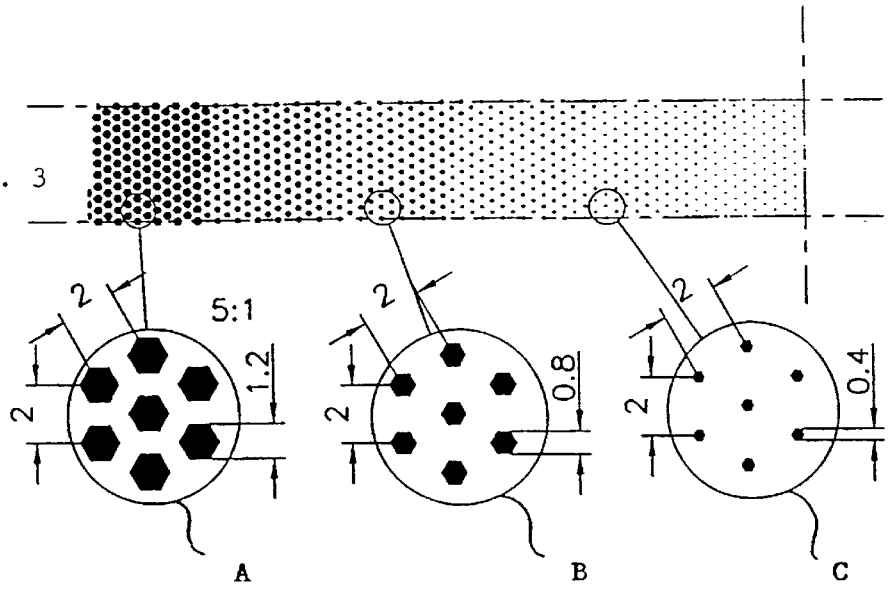
FIG. 3 shows in detail a section of the surface of the embodiment of the support shown in FIG. 2.

In FIG. 3 is illustrated the size variation of the protrusions in a section of the surface of the embodiment of the support according to the invention as shown in FIG. 2. The figure comprises 3 magnifications A, B, and C, where A illustrates a section of the surface where the hexagonal protrusions have a hexagonal width of 1.2 mm and a distance between the centres of 2 mm, B illustrates a section of the surface where the hexagonal protrusions have a hexagonal width of 0.8 mm and a distance between the centres of 2 mm, and C illustrates a section of the surface where the hexagonal protrusions have a hexagonal width of 0.4 mm and a distance between the centres of 2 mm.

Figure 4:
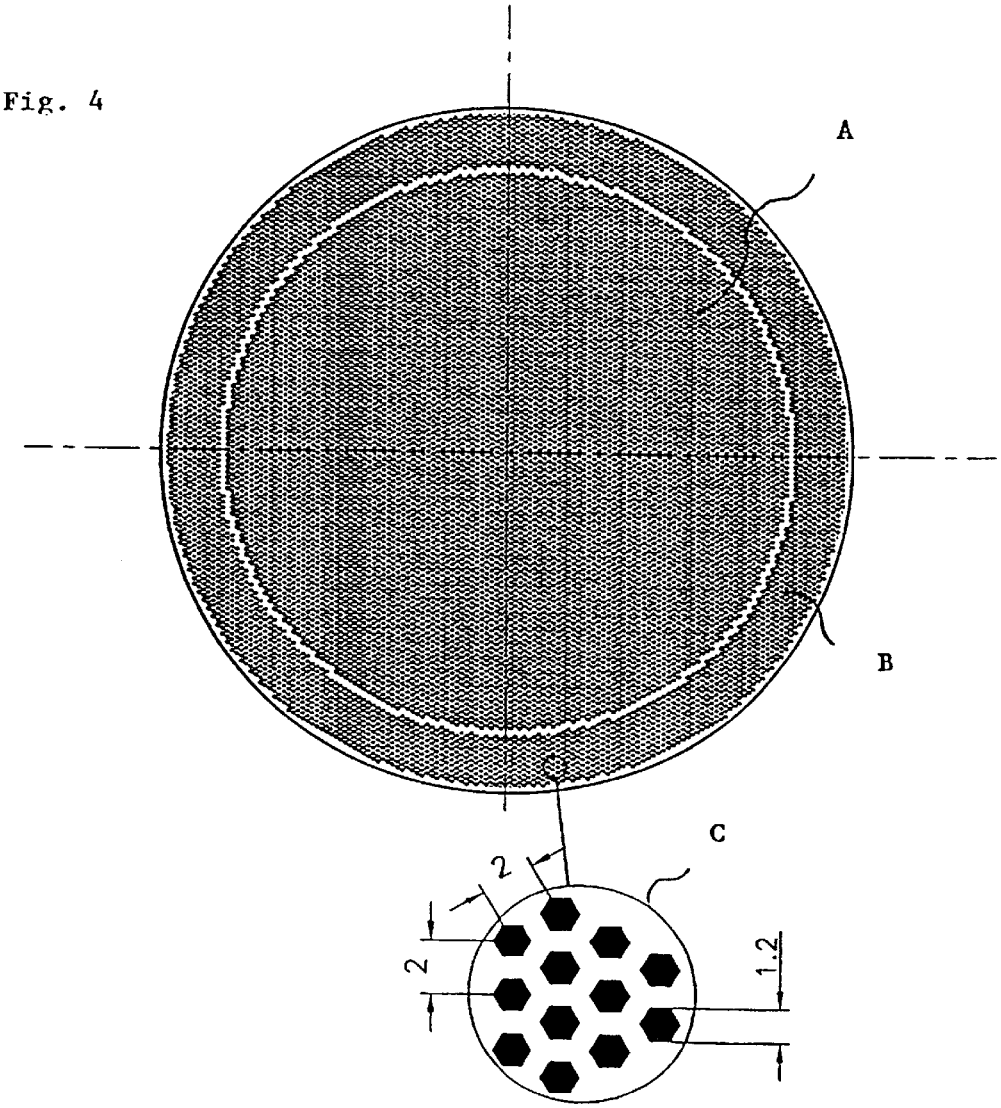
FIG. 4 shows the surface of another preferred embodiment of the support according to the invention.

FIG. 4 shows the surface of a preferred embodiment of the support according to the invention, where a first circular zone A is placed a the centre of the surface surrounded by a second annular zone B along the edge of the surface. The protrusions placed in zone A is composed by a material having a lower surface tension than the material used for the protrusion placed in zone B. The magnified sectional view C illustrates that all protrusions in both zones A and B are hexagonally shaped having a hexagonal width of 1.2 mm and are placed with a distance between the centres of 2 mm.

This embodiment corresponds to the embodiment of the invention disclosed in more detail in example 2 below.

The invention will now be further illustrated by means of examples.

EXAMPLE 1

This example illustrates an embodiment of the support according to the invention where the exhibited adhesive force is manipulated by applying one material having a first surface tension on a base material having a second surface tension and where the two materials constitute the surface of the support to receive the self-sticking polishing and/or abrasive means. The prescribed variation in adhesion is obtained by varying the amount of surface area of the base material covered by the applied material from the centre to the edge of the support.

A circular 0.28 mm thick tinned iron plate is coated entirely with 6 $\mu$m of a base epoxy lacquer having a surface tension of 34–36 dyn/cm.

A number of minute protrusions corresponding to the pattern shown in FIGS. 2 and 3 are printed on the plate using silk screen technique and using an epoxy lacquer having a surface tension of 42–50 dyn/cm with a suitable corresponding curing agent. The epoxy lacquer and curing agent of the mentioned type is e.g. mixed by using 400 g epoxy binder and 100 g curing agent. The epoxy composition is printed on the plate via a silk screen stencil in a 25 μm emulsion.

After printing, the plate is left to air dry for two weeks at 20° C. to obtain maximum adhesion and surface tension.

The printed pattern comprises hexagonal protrusions of the lacquer having a height of 10–15 μm. The protrusions vary in size from a hexagonal width of 0.1 mm at the centre to 1.2 mm at the edge, but the distance between the centres of the protrusions are constantly kept at 2 mm, thus exposing more of the base epoxy lacquer at the centre than at the edge.

EXAMPLE 2

This example illustrates an embodiment of the support according to the invention where the exhibited adhesive force is manipulated by applying two materials having different surface tensions on a base material and where the three materials together constitute the surface of the support to receive the self-sticking polishing and/or abrasive means. The prescribed variation in adhesion is obtained by using the two materials in separate zones exclusively.

A circular 0.28 mm thick tinned iron plate is coated entirely with 6 μm of a base epoxy lacquer having a surface tension of 34–36 dyn/cm.

A number of minute hexagonal protrusions corresponding to the pattern shown in FIG. 4 A are printed on the plate in a circular zone at the centre of the plate using silk screen technique and using an epoxy lacquer having a surface tension of 42–50 dyn/cm with a suitable corresponding curing agent. The epoxy lacquer and curing agent of the mentioned type is e.g. mixed by using 100 g binder and 25 g curing agent. The epoxy composition is printed on the plate using a silk screen stencil, in a 25 μm emulsion.

After leaving the plate to air dry for one day, a number of minute hexagonal protrusions corresponding to the pattern shown in FIG. 4 B are printed on the plate in an annular zone along the edge of the plate and surrounding the above mentioned circular zone at the centre of the plate using silk screen technique and using an polyurethane lacquer having a surface tension of 34–38 dyn/cm, with a suitable corresponding curing agent. The polyurethane lacquer and curing agent is e.g. mixed by using 300 g polyurethane binder and 40 g curing agent. The polyurethane composition is placed on the plate through a silk screen stencil, in a 25 μm emulsion.

All hexagonal protrusions used in this embodiment are placed at a centre distance of 2 mm, and have a hexagonal width of 1.2 mm.

After printing, the plate is left to air dry for two weeks at 20° C. to obtain maximum adhesion and surface tension.

The use of discrete protrusion of lacquer for this embodiment is primarily to obtain the above mentioned air effect. The two zones exhibiting different surface tensions and corresponding adhesion could be constituted by a continuous area.

What is claimed is:

1. A combination of a support means and a self-sticking abrasive or polishing sheet comprising an adhesive layer, said support means defining a generally planar support surface, said support surface exposing a first material of relatively high surface tension and defining a sub area which exposes a second material of relatively low surface tension, said support surface retaining a self-sticking abrasive or polishing sheet thereon when moved generally parallel to said generally planar support surface in use, but allowing easy separation of said sheet from said support surface perpendicularly therefrom for replacement.

2. A combination according to claim 1, wherein said support surface is circular and the resulting adhesive force between the sheet and the support is varied in a radial direction.

3. Support means for temporary fixation of a self-sticking abrasive or polishing sheet, said support means defining a generally planar support surface, said support surface exposing a first material of relatively high surface tension and defining a sub area which exposes a second material of relatively low surface tension, said support surface retaining a self-sticking abrasive or polishing sheet thereon when moved generally parallel to said generally planar support surface in use, but allowing easy separation of said sheet from said support surface perpendicularly therefrom for replacement.

4. Support means according to claim 3, wherein said support surface defines a plurality of sub areas which expose at least a second and third material of relatively low surface tension.

5. Support means according to claim 4, wherein said sub areas provide said support surface with a surface tension which varies from a center of said support surface to a periphery thereof.

6. Support means according to claim 5, wherein said surface tension varies continuously.

7. Support means according to claim 4, wherein said sub areas are formed as at least 2 annular rings.

8. Support means according to claim 5, wherein an average surface tension of an annular sub area surrounding a central sub area has a higher surface tension than a surface tension of said central sub area.

9. Support means according to claim 3, wherein the support surface comprises sub areas in the form of at least two per $cm^2$ of the support surface, said discrete sub areas being placed apart from each other and having a surface tension different from the surface tension of sub areas between the discrete sub areas placed apart from each other.

10. Support means according to claim 4, wherein the support surface comprises a plurality of protrusions.

11. Support means according to claim 4, wherein a periphery of the support surface is substantially circular.

12. Support means according to claim 11, wherein the support means is an integral part of a movable abutment in a grinding or polishing apparatus.

13. Support means according to claim 11, wherein the support means is an adapter for mounting on an existing movable abutment in a grinding or polishing apparatus.

14. Support means according to claim 13, wherein the support means is provided with an adhesive layer for permanent fixation to the movable abutment.

15. Support means according to claim 13, wherein the support means comprises ferro magnetic material for fixation to a magnetic movable abutment.

16. Support means according to claim 7, wherein an average surface tension of said sub areas increases continuously from a central sub area to a peripheral sub area.

17. Support means according to claim 7, wherein surface tensions of material in said annular rings varies continuously in a radial direction.

18. Support means according to claim 4, wherein the support surface comprises a plurality of cavities.

19. Support means according to claim 3, wherein said first material is selected from the group consisting of epoxy, cellulose polymers, polyamide, polyester, polycarbonate, resorcinol, phenol polymers and urea formaldelhyde.

20. Support means according to claim 19, wherein said second material is lacquer selected from the group consisting of polyurethane, polyethylene, polypropylene, rubbers, polystyrene, polyvinyl acetate, silicon polymers and polytetrafluoroethylene.

* * * * *